US006202838B1

(12) United States Patent
Tran

(10) Patent No.: US 6,202,838 B1
(45) **Date of Patent: *Mar. 20, 2001**

(54) ALBUM SLIP CASE WITH TRANSPARENT DISPLAY WALL AND DISPLAY RETAINER

(76) Inventor: Lam H. Tran, 7525 Oaktree Ave., Westminster, CA (US) 92683

( * ) Notice: Subject to any disclaimer, the term of this patent is extended or adjusted under 35 U.S.C. 154(b) by 0 days.

This patent is subject to a terminal disclaimer.

(21) Appl. No.: 09/420,525

(22) Filed: Oct. 19, 1999

Related U.S. Application Data

(63) Continuation-in-part of application No. 09/283,859, filed on Apr. 1, 1999, now Pat. No. 6,010,000.

(51) Int. Cl.[7] ..... A47G 1/06; A47G 29/00

(52) U.S. Cl. ..... 206/232; 40/722; 206/424; 206/457

(58) Field of Search ..... 40/703, 709, 710, 40/720–725; 206/232, 424, 455–457, 459.5

(56) References Cited

U.S. PATENT DOCUMENTS

| | | | | |
|---|---|---|---|---|
| 3,107,684 | * | 10/1963 | Apicella | 206/457 |
| 3,136,412 | * | 6/1964 | Karosen | 206/457 |
| 3,716,936 | * | 2/1973 | Miller | 40/720 |
| 3,774,332 | * | 11/1973 | Schneider | 40/720 |
| 4,195,729 | * | 4/1980 | Macken | 40/720 |
| 4,703,854 | | 11/1987 | Cline | 206/424 |
| 4,739,353 | | 4/1988 | Hever et al. | 206/776 |
| 4,854,060 | * | 8/1989 | Corbo et al. | 40/720 |
| 4,979,328 | * | 12/1990 | White | 40/720 |
| 5,421,111 | * | 6/1995 | Primm et al. | 40/721 |

* cited by examiner

*Primary Examiner*—Jim Foster
(74) *Attorney, Agent, or Firm*—Charles H. Thomas

(57) ABSTRACT

A photo album case or other storage container is formed with an outer shell having laterally enclosing walls and an end structure opposite an open end to the shell. At least one transparent display panel is formed in the shell, and preferably the shell is formed from a single sheet of transparent stock. A stiff, inner display retainer is inserted into the open end of the shell and fits into the storage cavity defined within the shell. The display retainer conforms to the shape of at least the transparent display panel wall. The display retainer preferably extends beyond the display wall to extend across another of the inner shell surfaces immediately adjacent thereto. A visual display sheet, such as a photographic print, is located between the transparent display wall and the display retainer. The display sheet may be merely inserted in between the transparent display wall and the display retainer, or it may be mounted upon either the retainer or the inner surface of the transparent display panel wall. In any of these arrangements the display retainer presses against the visual display sheet to hold it firmly against the central area of the display wall. The visual display sheet thereby provides an indicia of the contents of the storage container.

19 Claims, 13 Drawing Sheets

ALBUM SLIP CASE WITH TRANSPARENT DISPLAY WALL AND DISPLAY RETAINER

The present application is a continuation-in-part of U.S. Application Ser. No. 09/283,859, filed Apr. 1, 1999, now U.S. Pat. No. 6,010,000.

BACKGROUND OF THE INVENTION

1. Field of the Invention

The present invention relates to a photo album case or other storage container having a shell into which an album or other storage media may be inserted and removed.

2. Description of the Prior Art

Conventional photograph albums and other document storage devices are often provided with cases which receive the photo album or other storage medium therewithin. The storage medium may be a photo album, diary, notebook, account book, book of corporate records, or other article in which photographs, documents, keys, or other articles are stored. The case is typically formed with one closed end structure, wall panels laterally surrounding the closed end structure, and an open end opposite the closed end structure. The photo album or other binder or article containing the items to be stored slips into the shell through the open end and seats in abutting relationship against the opposite, closed end of the case.

In conventional photo albums or other storage cases the manufacturer sometimes provides a preprinted indicia across the closed end of either the spine of the album, the closed end of the case, or both, to aid the user in identifying the contents of the case. However, any such preprinted indicia is typically so general as to be of little value to the user.

SUMMARY OF THE INVENTION

The present invention relates to an improved slip case for photo albums or other binders that provides the user with a custom made content identification display sheet that may be easily applied and which will withstand extensive use. Moreover, the custom identification display sheet may be readily changed by the user for purposes of updating or alteration of the contents of the album housed within the case.

In one broad aspect the present invention may be described as a storage container comprising: an outer shell formed with laterally enclosing walls having inner and outer surfaces and opposing open and closed ends, wherein the shell includes a transverse, closed end structure having inner and outer surfaces and extending across the closed ends of the laterally enclosing walls, thereby defining a storage cavity therewithin. The open ends of the walls form and surround an open entry to the storage enclosure. At least one of the walls is a transparent display wall. A stiff, inner display retainer fits into the storage cavity and conforms to the shape of the inner surface of the display wall. A visual display sheet is located between the display wall and the display retainer. The display retainer presses against the inner surface of the transparent display wall. The display retainer thereby holds the visual display sheet pressed firmly against the inner surface of the display wall.

The outer shell of the storage container may take a number of different forms. For a photo album display case the outer shell of the storage container is typically formed in the shape of a hollow, rectangular prism having one open end and an opposite closed end structure. The shell or slip case may be made of different materials, such as die cut stiff paper, plastic sheet stock, or injection-molded plastic, but it must have at least one transparent display wall, typically formed of transparent polyethylene or some other transparent plastic sheet material. Portions of the shell may also be formed as an alloy casting, of cold forged metal, a ceramic or porcelain material, or bent sheet metal. Portions of the shell, other than the transparent display wall can also be formed of wood or cardboard. It is important for the outer shell of the storage container to be reasonably stiff and to be open at one end to receive the contents of the storage container, which is typically an album or binder of some sort.

The display retainer may likewise be fabricated from a number of different materials. For example, it may be formed from a single sheet of die cut stiff paper or plastic stock. The retainer may be formed as a single, flat panel, but may have at least one fold extending thereacross so as to delineate a display retaining panel and an adjacent support panel. The display retaining panel is disposed to face the inner surface of the display wall panel. At least one support panel preferably projects from the display retaining panel and is disposed to face one of the inner surfaces of the shell immediately adjacent the display wall panel.

In a preferred embodiment of the invention the retainer includes a pair of mutually parallel folds that form at least three distinct flat panels joined together by the folds. Two of the flat retainer panels are separated from each other by a distance equal to the width of the closed end structure of the shell. The area of the retainer between the folds in the pair of folds forms a web support panel. The retainer is then inserted into the shell with its central, web support panel disposed in a face-to-face relationship with the closed end structure of the shell. The web support panel is located between the retainer display panel on one side and another support panel extending outwardly toward the open end of the shell from the other side of the web support panel. When the stiff, inner display retainer is formed of a single sheet of stiff stock, folded in this fashion, it has a generally U-shaped configuration. The resiliency of the structure of the stock forming the retainer is normally sufficient to urge the display retaining panel and the support panel located opposite the display retaining panel on the other side of the web support panel toward the display wall and an opposing wall of the shell, respectively.

The visual display sheet may likewise take several forms. The visual display sheet may be a printed sheet of paper or card stock, a photograph, a title sheet, or any other thin, sheet-like structure upon which some indicia of the contents of the storage container is printed or inscribed. The visual display sheet may be of a size equal to the area of the inner surface of the transparent display wall and the area of the retainer display panel. That is, the visual display sheet may extend both the length and breadth of the transparent display wall and display retaining panel.

Alternatively, however, the visual display sheet may be of a size somewhat smaller than both the transparent display wall and the display retaining panel. When the visual display sheet is smaller than these surfaces, some type of mounting is employed to mount the visual display sheet on either the display retaining panel or on the inside surface of the transparent display wall. For example, corner slits may be cut into the display retaining panel to receive the corners of the visual display sheet. The visual display sheet is thereby mounted on the display retaining panel and is preferably centered within the area of the transparent display wall panel of the shell for ease of viewing. Also, the visual display sheet may be mounted directly on the retainer by means of double-sided adhesive tape, by tape at the corners or edges, by photograph corner mounts, by glue, heat sealing or staples, and other available mounting systems.

The visual display sheet may be mounted on the retainer in other ways, as well. For example, In a preferred arrangement some, but not all, of the peripheral edges of a transparent sheet of pocket material may be secured to the outwardly facing surface of the display retaining panel. The transparent pocket sheet may be secured to the display retaining panel by heat sealing, glue, double-sided adhesive tape, staples, or any other conventional fastening system. Whatever the form of attachment, the visual display sheet is preferably inserted in between the transparent display wall of the shell and the display retaining panel and is held pressed against the display wall so as to be visible through the transparent display wall of the shell and so as not to interfere with insertion of an album into the shell.

In one embodiment of the invention the shell is provided with catch members at the open end of the transparent display wall panel and at the open end of at least one other of the wall panels so as to engage the retainer and hold it within the shell. The catch mechanism may take the form of a restraining tab having an anchored end secured to the open end of one of the walls of the shell and a free end directed toward the closed end structure of the shell. With this construction the catch member engages and retains an edge of the display retainer.

Alternatively, the catch member may be formed by a raised lip secured to the inner surface of the outer end of at least one of the walls of the shell. The display retaining panel and the support or bracing panel have outer edges that reside in abutment against the raised lips. The raised lips thereby prevent the edges of the album or binder from catching on the edges of the retainer when the album or binder is inserted into the shell of the case.

In another aspect the invention may be considered to be an album case comprising a shell, a stiff display retainer, and a display sheet. The shell has a closed end with an end structure having inner and outer surfaces, an opposite open end, and a plurality of wall panels having inner and outer surfaces and extending between the closed end structure and the open end of the shell. At least one of the panels of the shell is a transparent display panel. The stiff display retainer has at least one flat retainer panel which presses against the inner surface of the transparent display panel. A display sheet is interposed between the inner surface of the transparent display panel and the retainer panel.

The invention may be described with greater clarity and particularity with reference to the accompanying drawings.

DESCRIPTION OF THE EMBODIMENTS

Figure 1:
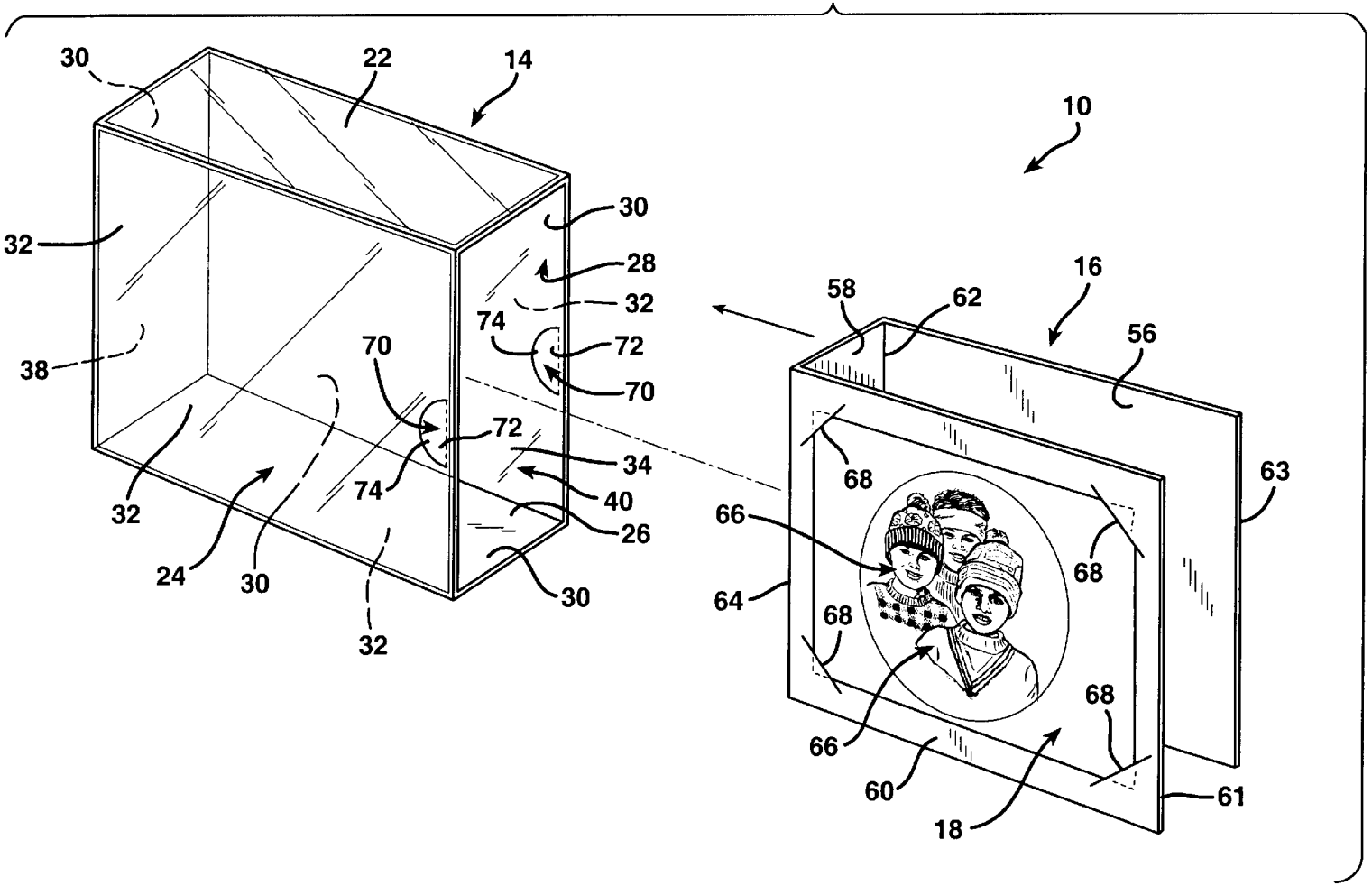
FIG. 1 is an exploded, perspective view illustrating one preferred embodiment of a storage container constructed according to the invention.
Figure 2:
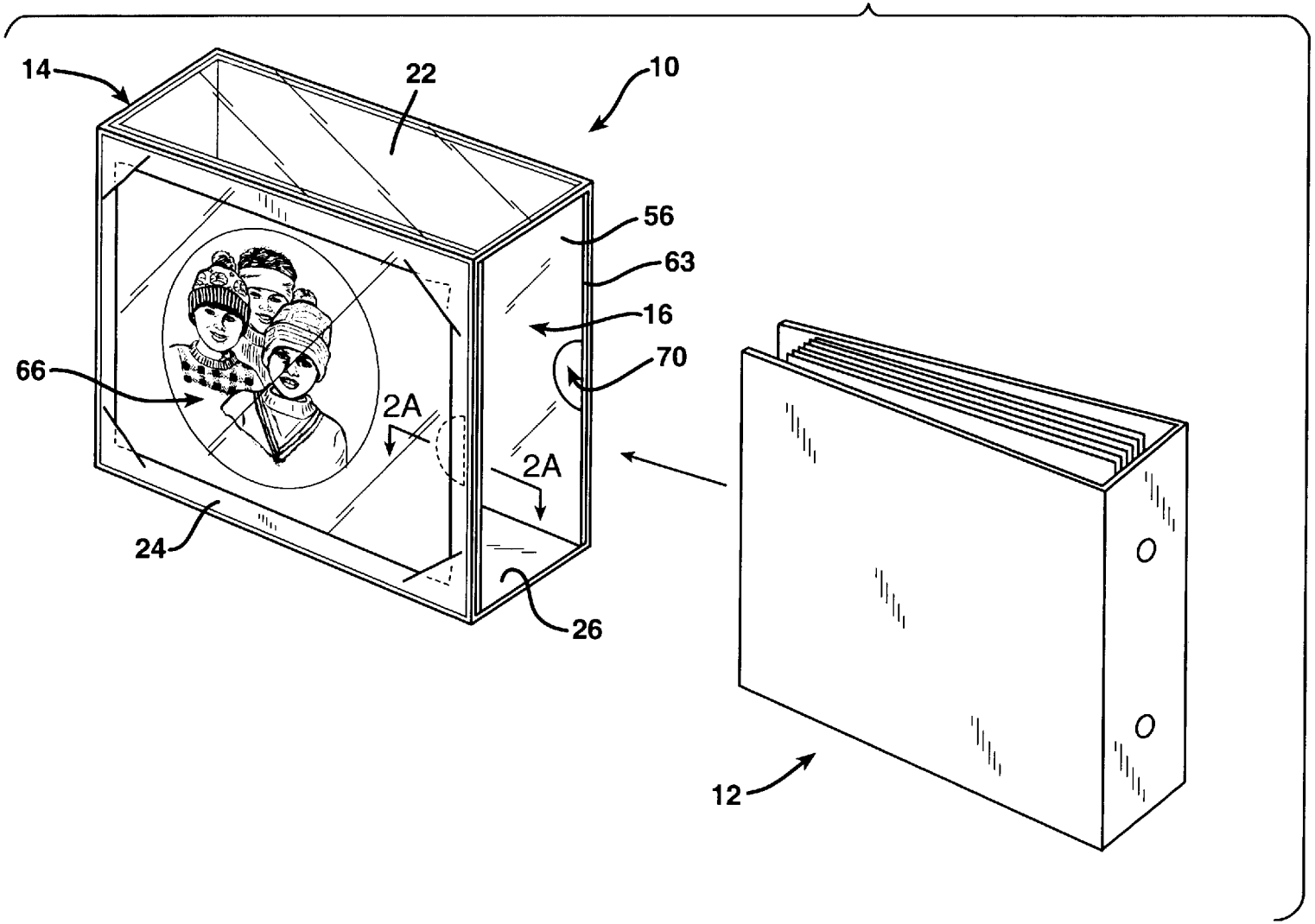
FIG. 2 is a perspective view illustrating the component parts of the storage container of FIG. 1 assembled together in preparation for receipt of a photo album.

FIG. 1 illustrates a photo album case 10 adapted to receive and store a photo album 12 of the type shown in FIG. 2. The photo album case 10 is comprised of a transparent shell 14, a stiff display retainer 16, and a visual display sheet 18.

Figure 1A:
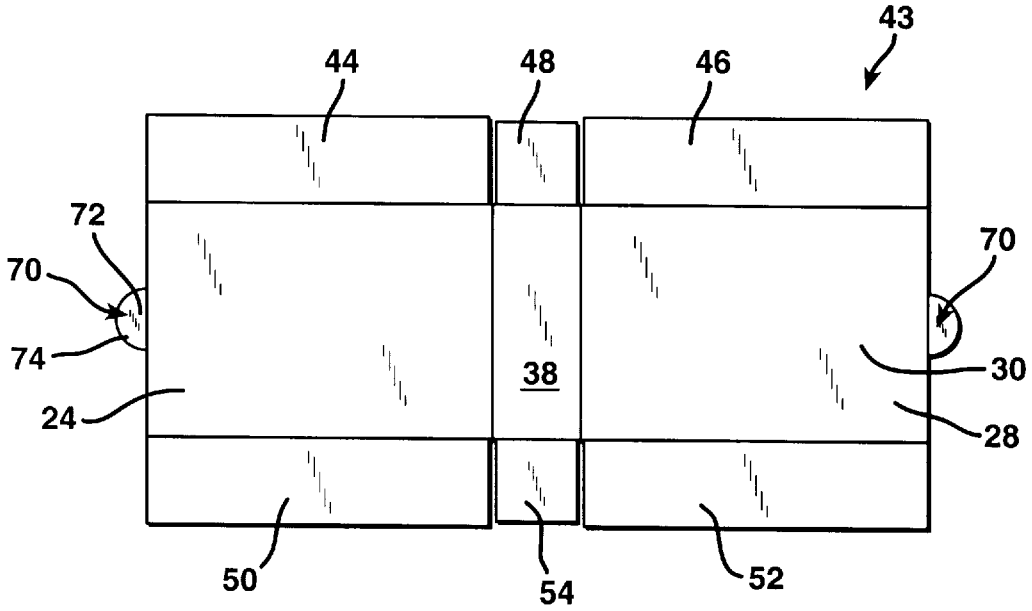
FIG. 1A is a plan view illustrating the structure of the outer shell of the storage container of FIG. 1 in a flattened condition prior to folding and assembly.

The photo album shell 14 is formed from a single sheet 43 of stiff transparent plastic, such as polyethylene, shown in a flattened condition in FIG. 1A prior to fabrication of the shell 14. When constructed, the shell 14 has four rectangular walls 22, 24, 26, and 28 having inner surfaces 30 and outer surfaces 32. The walls 24 and 28 are each formed by single, separate panels of the sheet 43, while the top wall 22 and the bottom wall 26 of the shell 14 are formed by a plurality of overlapping panels and flaps. Specifically, the top wall 22 is formed by panels 44 and 46 and by a flap 48 sandwiched therebetween. The bottom wall 26 is formed by panels 50 and 52 with a flap 54 sandwiched therebetween.

The shell 14 has an open end 34 and a closed end 38. The closed end 38 of the shell 14 is formed by a single rectangular closed end panel which, like the walls, has an inner surface 30 and an outer surface 32. Each of the walls 22, 24, 26, and 28 has an open end, which forms and defines the open end 34 of the shell 14, and a closed end to which the closed end panel 38 is secured. The structure of the closed end panel 38 extends transversely across all of the closed ends of the walls 22, 24, 26, and 28. As illustrated in FIGS. 1 and 2, the shell 14 defines a hollow album enclosure indicated generally at 40.

At least one of the walls 22, 24, 26, and 28 must be transparent to serve as a display wall. In the embodiment of the invention depicted in FIG. 1, all of the walls 22, 24, 26, and 28 and the end panel 38 of the shell 14 are transparent, but only the wall 24 is used as a display wall.

The single sheet 43 of stiff, flat transparent polyethylene plastic stock that forms the shell 14 is illustrated in a flattened condition, prior to assembly of the shell 14, in FIG. 1A. As shown in that drawing figure, the narrow closed end panel 38 lies between the broad, rectangular display wall panel 24 and the broad, rectangular opposing wall panel 28. The wall panel 28 is oriented parallel and opposite to the display wall panel 24 when the shell 14 is assembled as depicted in FIGS. 1 and 2. The top wall 22 is formed by a pair of relatively narrow wall panels 44 and 46 which extend, respectively, from the upper edges of the display wall panel 24 and the opposing wall panel 28. A square flap 48 at the top of the closed end wall panel 38 also forms a part of the top wall 22. Specifically, when the flat transparent sheet 43 is folded from its flattened condition depicted in FIG. 1A, the flap 44 forms the inner surface 30 of the top wall 22, while the other top flap 46 forms the outer surface 32 of the top wall 22. The flap 48 is sandwiched in between or beneath the flaps 44 and 46. The flaps 44, 46, and 48 are secured to each other by an adhesive applied on both sides of the flap 48 and by adhesive between the mutually facing concealed surfaces of the flaps 44 and 46.

Similarly, the bottom wall panel 26 is formed by panels 50 and 52 which extend respectively from the lower edges of the display wall panel 24 and the opposing wall panel 28. Another square flap 54 projects from the lower edge of the closed end wall panel 38. The exposed surface of the panel 50 forms the inner surface 30 of the bottom wall panel 26, while the exposed surface of the panel 52 forms the outer surface 32 of the bottom wall panel 26. Adhesive is applied to both sides of the square flap 54, which is sandwiched in between the flaps 50 and 52. Adhesive is also applied to the portions of the flaps 50 and 52 which face and contact each other. When the adhesive has been applied to the flaps as described, and the flaps 44 and 46 have been folded into contact with each other and with the flap 48 and when the panels 50 and 52 have been folded into contact with each other and with the flap 54, as described, the shell 14 is formed so that the storage cavity 40 has the shape of a rectangular prism, as illustrated in FIG. 1.

The order of folding the flaps is merely a matter of preference. For example, the flaps 48 and 54 may be folded in first and form portions of the inner surface 30 of the upper and lower panels 22 and 26. Also, when the nature of the materials permits, the flaps and panels can be attached to each other by heat sealing or sonic welds rather than adhesive.

Figure 1B:
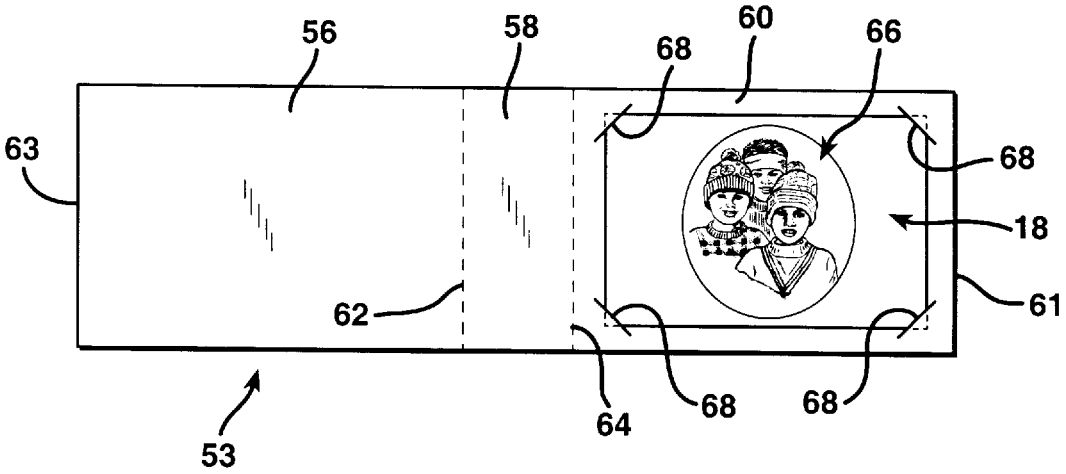
FIG. 1B is a plan view illustrating the structure of the retaining panel of the storage container of FIG. 1 shown in a flattened condition prior to folding.

The display retainer 16 is formed from a single sheet of flat, stiff, resilient material 53, such as card stock or plastic, illustrated in a flattened form in FIG. 1B. The sheet of material 53 forming the retainer 16 is delineated into distinct, rectangular container panels by at least one liner fold. In the embodiment of FIGS. 1 and 1B, the retainer 16 is formed with three rectangular panels 56, 58, and 60 by a pair of mutually parallel, straight, linear folds 62 and 64. The folds 62 and 64 form demarcations between the display retaining panel 60, the web support panel 58, and the opposing, return panel 56. The folds 62 and 64 form linear, articulated connections between the retainer panels 56, 58, and 60. When the retainer 16 is bent along the folds 62 and 64, it assumes basically a U-shaped configuration, but due to the resiliency of the sheet 53 from which they are formed, the retainer panels 56, 58, and 60 are resiliently biased apart from each other with a slight force. The folds 62 and 64 serve as articulated joints between the discrete retainer panels 56, 58, and 60.

The retainer panel 60 serves as a display retaining panel for mounting the display sheet 18, which in the embodiment depicted is a sheet containing a photograph 66. The fold 64 forms an articulated joint between the display retaining panel 60 and the adjacent, narrower panel 58, which serves as a web support panel. The web support panel 58 has a width, as measured between the folds 62 and 64, nearly equal to the width of the inner surface 30 of the closed end panel 38 of the shell 14. The fold 62 delineates the web support panel 58 from a return or bracing panel 56 that has the same dimensions as the display retaining panel 60 and which is located directly opposite therefrom when the retainer 16 is in use, as depicted in FIGS. 1 and 2.

The retainer 16 fits into the storage cavity 40 between the open and closed ends of the shell display wall panel 24 and conforms to the shape of and substantially covers the inner surface 30 of the display wall 24. The web support panel 58 of the display retainer 16 extends beyond the display wall 24 to extend completely across another of the inner surfaces 30 of the shell 14 immediately adjacent thereto. Specifically, in the embodiment of FIGS. 1 and 2, the web support panel 58 of the retainer 16 extends completely across the inner surface 30 of the closed end panel 38 of the shell 14 and resides in contact therewith.

The display retaining panel 60 extends between the open and closed ends of the display wall panel 24. The display retaining panel 60 is substantially coextensive in surface area with the area of the inner surface 30 of the display wall panel 24. The display retaining panel 60 of the retainer 16 contacts and conforms to the shape of the inner surface 30 of the transparent display wall 24 of the shell 14.

The web support panel 58 extends beyond the display retaining panel 60 and completely covers the inner surface 30 of the transverse end panel 38 of the shell 14 immediately adjacent to the transparent display wall 24. The web support panel 58 is coextensive in area with the inner surface 30 of the end panel 38 of the shell 14 immediately adjacent the display wall panel 24.

The bracing or return panel 56 is joined to the web support panel 58 and resides in contact with the back wall 28 of the shell 14, which is parallel to and located opposite the display wall 24. The return panel 56 of the retainer 16 is substantially coextensive in surface area with the wall panel 28 of the shell 14 that lies directly opposite the display panel 24 thereof.

The resiliency of the sheet 53 from which the retainer 16 is constructed holds the panels 60 and 56 pressing outwardly, respectively, against the shell display wall 24 and the opposing shell wall 28. The retainer 16 thereby forms a liner within the shell enclosure 40. A photographic album 12 can then be inserted into the enclosure 40 within the embrace of the display retaining panel 60 and the return panel 56 in the manner depicted in FIG. 3.

When the retainer 16 is inserted into the shell 14, the top and bottom edges of all of the retainer panels 56, 58, and 60 reside in contact with the inner surfaces 30 of the top side wall 22 and the bottom side wall 26 of the shell 14. The tight fit, coupled with the outwardly acting flexure of the end retaining panels 56, and 60 from the central web support panel 58 are normally sufficient to hold the outer edges of the retaining panels 56 and 60 apart to prevent them from interfering with the insertion of the photograph album 12 into the storage enclosure 40. However, as a further safeguard, it is sometimes advisable to provide the shell 14 with at least one catch member at the open end 34 thereof to engage the display retainer 16 and hold it within the storage cavity 40 pressed against at least some of the inner surfaces 30 of the shell 14.

The tabs 70 serve as catch members in the embodiment of FIG. 1. The single sheet 43 that forms the hollow shell 14 is also provided with semicircular tabs 70 that prior to folding project laterally from the open ends of the side wall panels 24 and 28, as illustrated in FIG. 1A. In constructing the shell 14, the tabs 70 are bent inwardly and are heat sealed or otherwise secured to the inside surface 30 of the side wall panels 24 and 28 at their margins 72 immediately adjacent to their fold lines. The shell 14 is thereby formed with restraining tabs 70 on opposite sides of the open end 34 of the shell 14. The restraining tabs 70 are clearly visible in FIG. 1.

As shown in FIG. 1, the restraining tabs 70 each have an anchored end or margin 72 secured to the open end the side wall panel 24 or 28 of the shell 14. A free end 74 of each restraining tab 70 is directed back toward the closed end panel 38 of the shell 14. The restraining tabs 70 thereby serve as catch members, one of which engages and restrains the edge 63 of the return panel 56 and the other of which engages and restrains the edge 61 of the display retaining panel 60. Both of the edges 61 and 63 of the retainer 16 are located at the open end 34 of the shell 14. The restraining tabs 70 ensure that the display retaining panel 60 remains pressed against the display wall panel 24 of the shell 14 and that the return panel 56 of the retainer 16 is held pressed against the opposing side wall panel 28 of the shell 14. This prevents any interference by the retainer 16 with insertion of the photographic album 12 in the manner depicted in FIG. 2.

Diagonal mounting slits 68 are die cut into the structure of the display retaining panel 60 near the corners thereof. The visual display sheet 18 is a rectangular sheet of photographic paper formed with corners which are inserted through the mounting slits 68 in the retainer 16, as illustrated in FIGS. 1, 1B, and 2. The mounting slits 68 in the retainer 16 provide a mechanism for mounting the visual display sheet 18 upon the retainer 16, centered within the display retaining panel 60. The display sheet 18 is also centered within the display wall 24 of the shell 14 when the photo album case 10 is assembled, as illustrated in FIG. 2.

As illustrated in FIG. 1B, the album case 10 is assembled by first mounting the visual display sheet 18 on the display retaining panel 60. The retainer 16 is then bent along the lines 62 and 64 into a U-shaped configuration as illustrated in FIG. 1. The retainer 16, with the visual display sheet 18 mounted thereon, is next inserted into the shell enclosure 40 with the web support panel 58 facing the closed end panel 38 of the shell 14. The U-shaped retainer 16 is inserted into the shell 14 so that the display retaining panel 60 and the visual display sheet 18 mounted thereon slide along the inside surface 30 of the transparent display panel wall 24. When the retainer 16 has been fully and completely inserted into the shell 14, the web support panel 58 resides in face-to-face abutment against the transverse shell end panel 38.

Figure 2A:
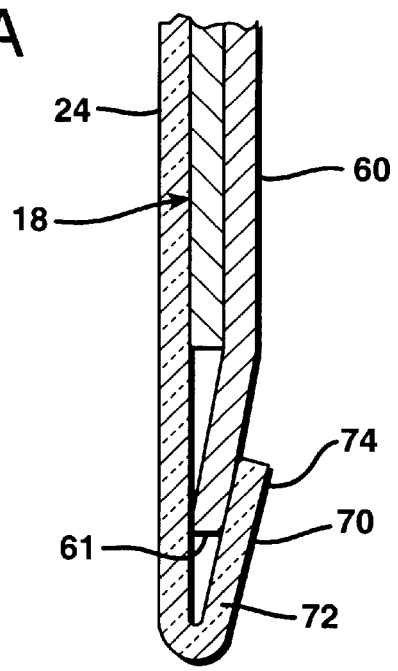
FIG. 2A is a sectional plan detail taken along the lines 2A—2A of FIG. 2.

Once the web support panel 58 has been moved into contact with the closed end panel 38, the display-retaining panel 60 and the return panel 58 are flexed so that their respective edges 61 and 63 can be inserted in between the free ends 74 of the restraining tabs 70 and the inside surfaces 30 of the transparent display wall 24 and the opposing side wall panel 28, as illustrated in FIG. 2A. The free ends 74 of the tabs 70 are lifted inwardly to clear the exposed edges 61 and 63 of the display retaining panel 60 and the return panel 56. The free ends 74 of the tabs 70 are then released so that they reside against the inside surfaces of the open ends of the retaining panels 56 and 60 to capture the exposed edges 61 and 63 thereof between the tabs 70 and the side wall panels 24 and 28 of the shell 14.

The tabs 70 thereby ensure that the panels 60 and 56 remain in contact with the display wall 24 and the opposing wall 28 of the shell 14. Also, the tabs 70 serve the additional function of preventing the edges of the album 12 from catching upon the edges 61 and 63 of the display-retaining panel 60 and the return panel 56, respectively, when the album 12 is inserted into the shell 14 with the display retainer 16 located therein.

Because the display wall 24 of the shell 14 is transparent, the photograph 66 of the photographic visual display sheet 18 is highly visible through the display wall 24, as illustrated in FIG. 2, but is protected from fingerprints and other soiling by the transparent display wall 24. The photograph 66 provides a ready indication of the contents of the photo album 12, since the selection of the visual display sheet 18 is totally within the discretion of the owner of the album 12.

It can be seen that any number of different types of visual display sheets may be mounted in the retainer 16. Instead of the photographic display sheet 18 depicted, the user may wish to insert instead a title page or table of contents consisting entirely of text material. Also, it is quite easy for the user to remove and replace the visual display sheet 18 with an updated or substitute version of it. The identifying sheet, visible externally from the photo album case 10 allows the user to readily ascertain the contents of the photographic album 12 with merely a glance at the album case 10.

Figure 14:
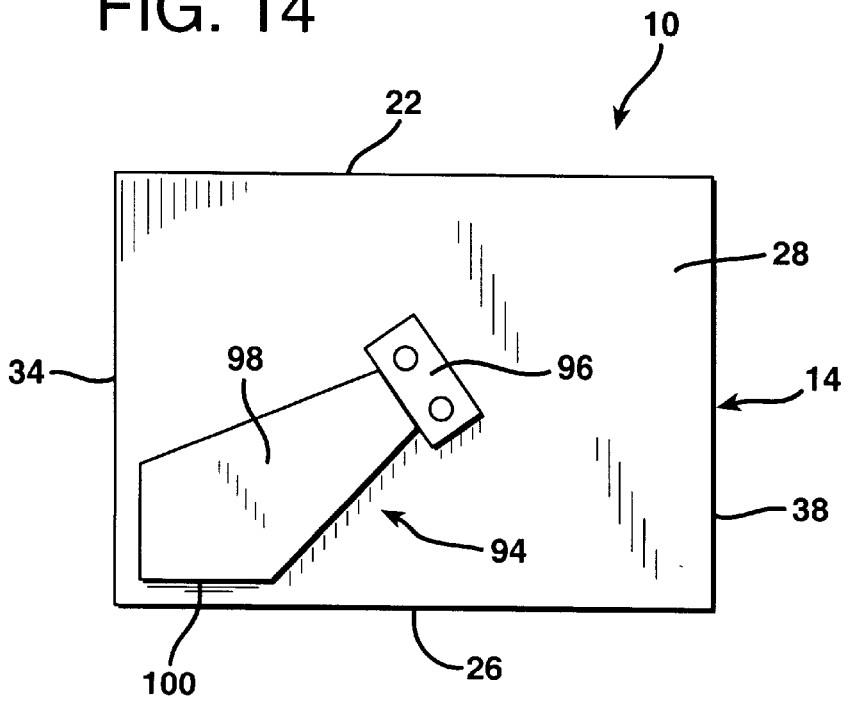
FIG. 14 is an elevational view of an embodiment of a storage container according to the invention constructed with a retractable stand.

As illustrated in FIGS. 1 and 2, the shell 14 is normally oriented for display so that the sets of wall panels and flaps 44, 46, and 48 and 50, 52, and 54 respectively form mutually opposing top and bottom walls 22 and 26. The display wall 24 and the opposing back wall 28 serve as mutually opposing side walls. As shown in FIG. 14, a foldable stand 94 may be secured to the outer surface 32 of the other opposing wall, namely the back wall 28 opposite the display wall 24. The foldable stand 94 includes an attachment pad 96 that is secured to the outside 32 of the back wall 28 and a leg 98 that extends downwardly and forwardly from the anchoring pad 96. The leg 98 is inclined downwardly at an angle relative to the lower edge of the back wall 28 so that it can be folded out and thereby deployed to project outwardly and downwardly to a surface upon which the shell 14 rests. When the stand leg 98 is rotated outwardly away from the outer surface 32 of the back wall 28, the lower edge 100 of the stand leg 98 reaches a horizontal surface upon which the shell 14 rests. The leg 98 thereby supports the shell 14 so that the opposing side walls, namely the display wall 24 and the opposing back wall 28 are held oriented in the upright disposition, illustrated in FIGS. 1 and 2.

Figure 3:
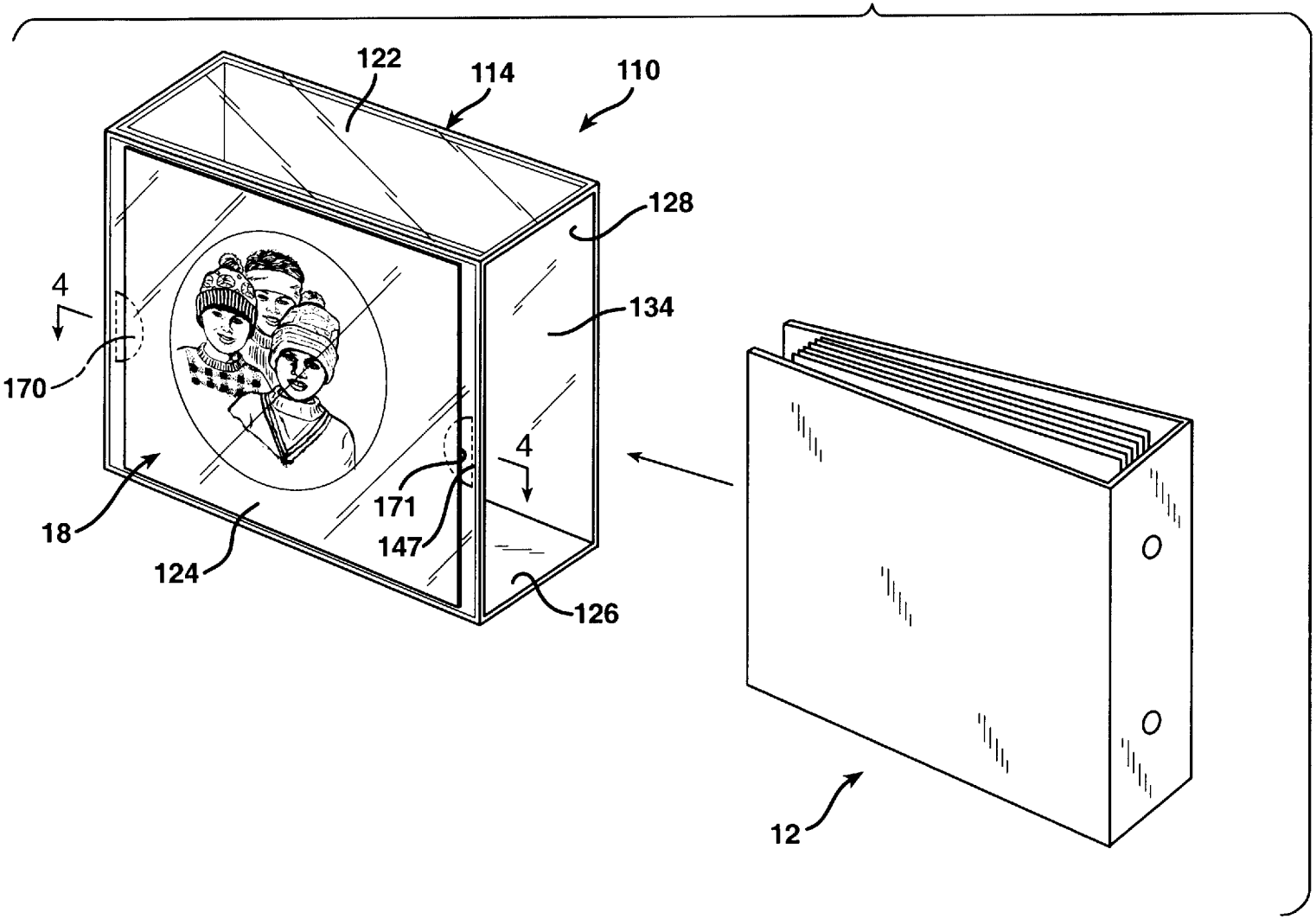
FIG. 3 is a perspective view illustrating the component parts of another preferred embodiment of a storage container constructed according to the invention assembled in preparation for receipt of a photo album.
Figure 4:
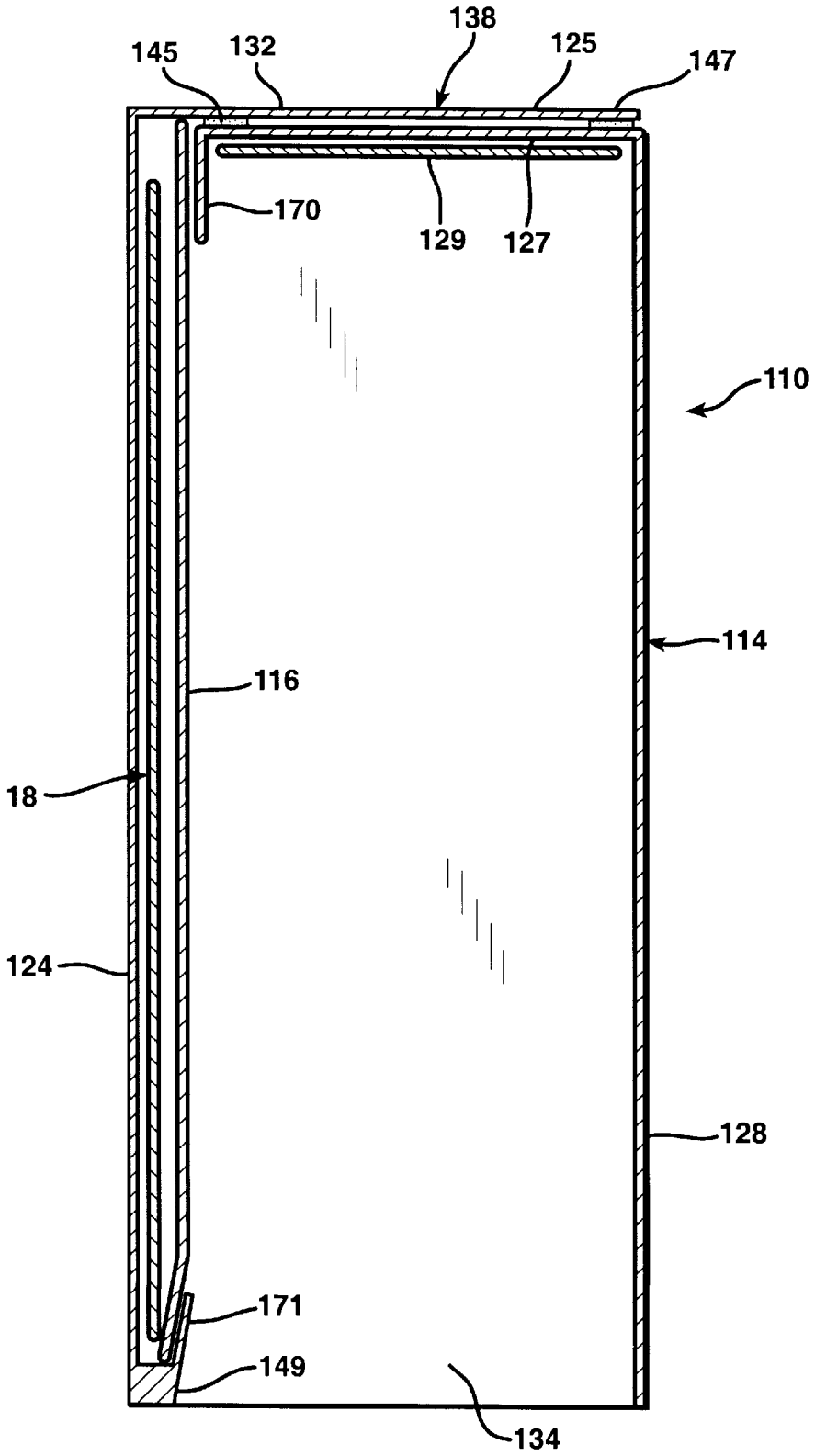
FIG. 4 is a sectional plan view taken along the lines 4—4 of FIG. 4.
Figure 4A:
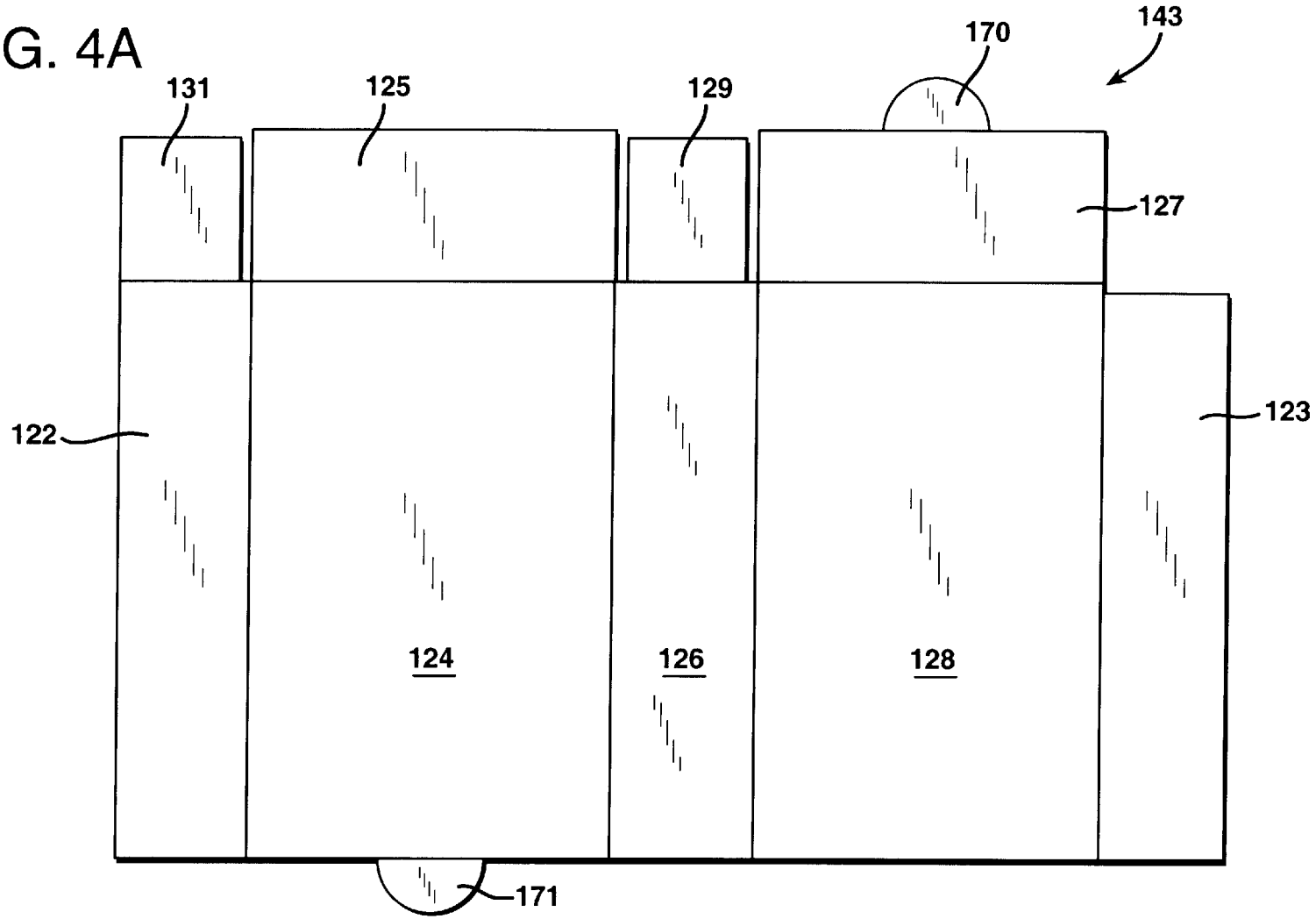
FIG. 4A is a plan view illustrating the structure of the shell of the storage container of FIG. 4 in a flattened condition prior to folding and assembly.

FIGS. 3, 4 and 4A illustrate an alternative embodiment of the invention indicated generally at 110. In the embodiment of FIG. 4, the outer shell 114 is constructed from a single sheet of flat stock 143, as shown in FIG. 4A. The sheet of flat stock 143 is formed of a transparent plastic, such as polyethylene. The sheet 143 defines a broad front, transparent display wall 124; a narrower, rectangular bottom wall 126; a broad back wall 128 having the same size and shape as the front display wall 124; a narrow outer top wall flap 122 projecting from the display wall panel 124 and having the same size and shape as the bottom wall 126; and a narrow top wall inner flap 123 projecting from the back wall 128. Also, outer and inner end wall flaps 125 and 127, respectively, project from the ends of the large, rectangular side wall panels 124 and 128, and end wall flaps 129 and 131 project from the bottom panel 126 and from the top wall flap 122, respectively.

The sheet 143 is folded so that the top wall inner flap 123 resides underneath the top wall outer flap 122 and is sealed thereto throughout the mutual surfaces of contact between the top wall flaps 122 and 123. The end flaps 129 and 131 are folded upwardly and downwardly, respectively. The inner end wall flap 127 is then folded inwardly so that it forms the inner end surface of the enclosure 140. The retaining tab 170 projecting from the panel 127 is folded so that it is directed back toward the open end 134 of the shell 114. The outer end wall flap 125 is then folded up against the outwardly facing surfaces of the inner end wall flap 127 and against the flaps 129 and 131. The outer end wall flap 125 thereby forms the outwardly facing surface 132 of the closed end structure 138 of the shell 114.

Heat seals or sonic welds are formed at 145 and 147 throughout the lengths of the end wall flaps 125 and 127 proximate the side panel walls 124 and 128, as illustrated in FIG. 4. Also, the sheet 143 is provided with an edge margin retaining tab 171 that is turned back from the open end 134 of the shell 114 and heat sealed at 149 to the transparent display wall 124. The retaining tabs 170 and 171 thereby form retainers at the closed end and at the open end, respectively, of the transparent display wall 124. These retainers, or catches, 170 and 171 capture the vertical edges of the display retainer 116.

The retaining tabs 170 and 171 form catches that confine the single sheet display retainer 116 to a location immediately adjacent the transparent display wall 124. The display sheet 18 may be mounted on the single sheet retainer 116 by means of corner cuts therein, in the manner previously described, or by some other fastening system, such as the different fastening arrangements hereinafter described.

The catches 170 and 171 have free ends directed toward each other from the opposite ends of the shell 114. The retaining tab 170 projects toward the open end of the shell 114 from immediately adjacent the closed end of the transparent display panel 124 where it joins the closed end 138. The retaining tab 171 projects toward the closed end of the shell 114 from the opposite, open end 134 of the shell 114.

Figure 6:
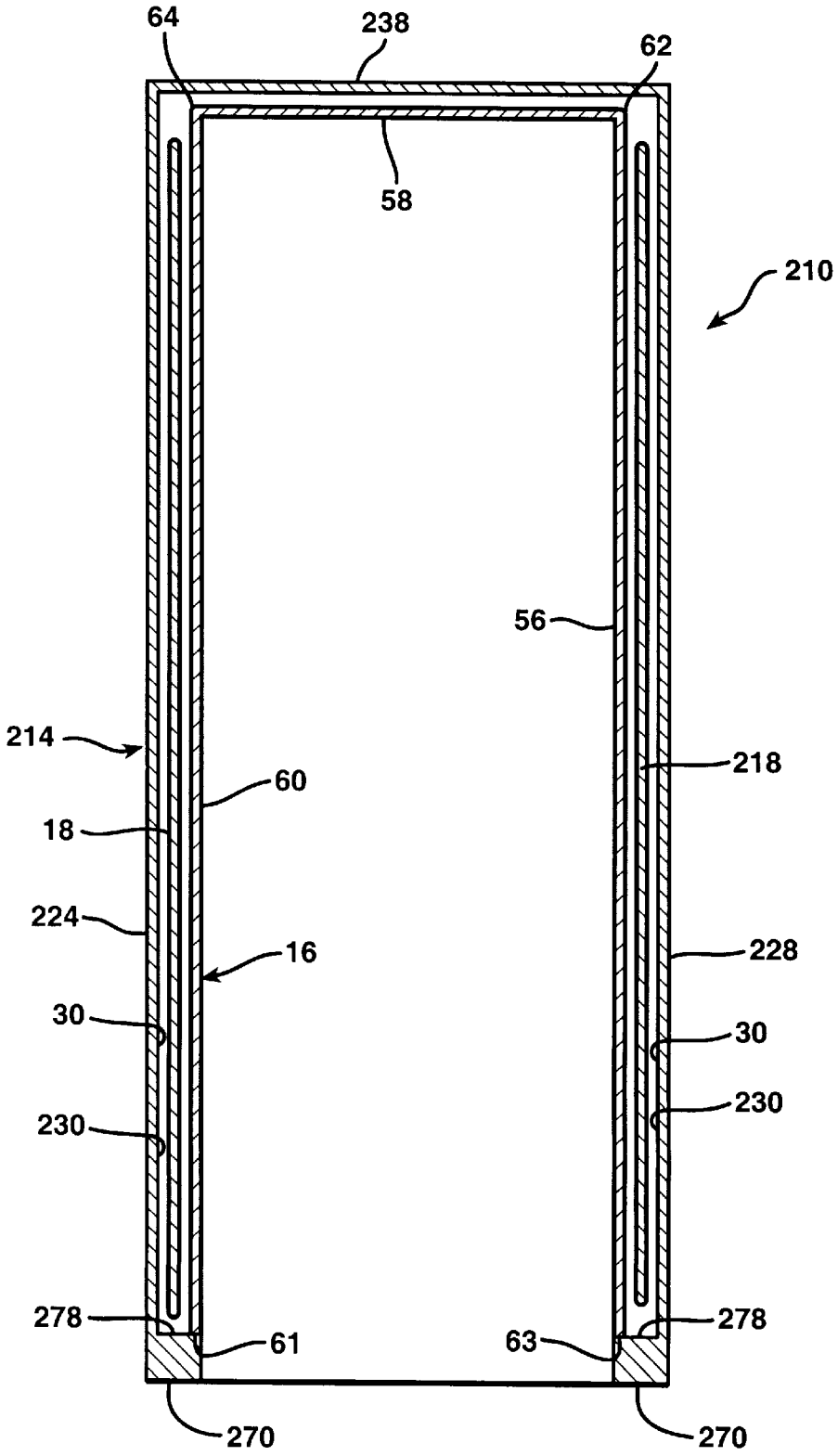
FIG. 6 is a sectional plan view that illustrates an alternative embodiment of a storage container according to the invention having a plurality of visual display sheets and a plurality of transparent display walls.

FIG. 6 is a plan sectional view that illustrates an album case 210 which is a further alternative embodiment according to the invention. The album case 210 has all of the components elements of the album case 10 shown in FIGS. 1 and 2, but in addition has a pair of catch members 270 that extend along the edges of the outer ends of the display wall panel 24 and the opposing wall panel 28 at the open end 234 of the shell 214. The pair of catch members 270 of the album case 210 may be formed as a pair of thickened beads that are raised lips at the outer edge of the display wall panel 224 and at the outer edge of the opposing back wall panel 228 at the open end 234. The beads forming the catch members 270 on the inside surfaces 230 of the wall panels 224 and 228 project a short distance toward each other to form abutment ledges 278. The outwardly facing edges 61 and 63 of the retainer 16 are captured by and reside in abutment against the raised lips that form the catches 270.

The outwardly directed springiness of the display retaining panel 60 and the return panel 56 ensures that the retainer panels 60 and 56 reside flat and press outwardly against the wall panels 224 and 228 of the shell 214 against which they bear. The abutting engagement of the ledges 278 of the catches 270 and the edges 61 and 63 of the retainer panels 60 and 56, respectively, ensure that the retainer 16 remains in position within the shell 214 unless purposefully removed therefrom.

In the embodiment of FIG. 6, both the front wall panel 224 and the opposing back panel wall 228 are utilized as display wall panels. In the album case 210 shown in FIG. 6, the back panel 56 of the retainer 16 serves as a second display panel and has another display sheet 218 mounted on it, in addition to the display sheet 18 mounted on the front display panel 60 as shown in FIGS. 1 and 2. The display sheet 218 may be attached to the return or back panel 56 in the same manner that the display sheet 18 is attached to the front display panel 60, or in a different manner.

While the catches 270 that are formed on the shell 210 illustrated in FIG. 6 are created as thickened beads at the open edges of the transparent display side walls 224 and 228, catches that perform the same function may be formed in other ways as well. For example, the ends of the transparent side walls 224 and 228 may be formed with marginal strips that are folded back and heat sealed to the inside surfaces 30 of the display walls 224 and 228 so as to project back toward the closed end 238 of the shell 210. The lips thus formed can be constructed so as to reside in abutment against the ends 61 and 63 of the retainer panels 60 and 56, respectively. Alternatively, they can be configured to create pockets that receive the edges 61 and 63 of the retainer panels 60 and 56. In such an arrangement the edges 61 and 63 are sandwiched between the structures of the panels 224 and 228 and the catches 270 thus formed by the rearwardly facing vertical pockets or grooves formed in the thickened beads.

Figure 7:
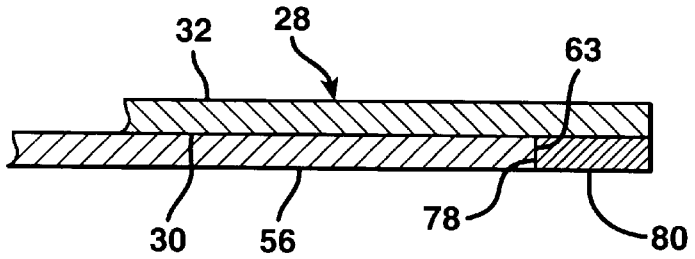
FIG. 7 is a plan sectional detail illustrating a portion of the structure of the open end of another embodiment of the storage container of the invention.

FIG. 7 illustrates a modification of the catch arrangement depicted in FIG. 6. Specifically, in FIG. 7 the sheet forming the shell of the album case has a uniform thickness throughout. The lips 80 which serve as catches are formed as additional, narrow strips that are heat sealed or secured by adhesive to the open ends of the wall panels 24 and 28 of the shell 14. The lips 80 are not formed by beads or folded margins extending from those wall panels, but rather by separate, narrow strips of stiff plastic, card stock, or some other stiff material. The narrow strips forming the lips 80 also provide inwardly facing abutment ledges 78 that engage the corresponding outwardly facing abutment edges 61 and 63 of the retainer panels 60 and 56, respectively.

Figure 8:
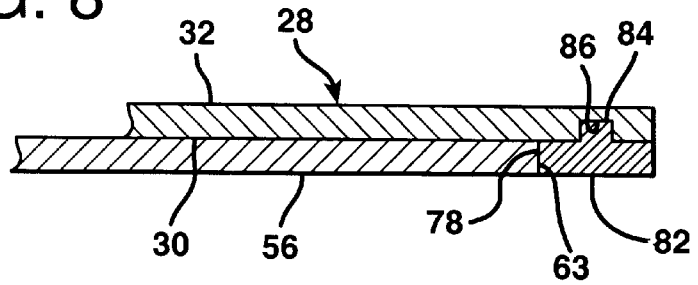
FIG. 8 is a plan sectional detail illustrating a portion of the structure of the open end of still another embodiment of the storage container of the invention.

FIG. 8 illustrates still another variation of a catch mechanism in which a lip 82 is formed as a narrow, separate strip, preferably between about one-sixteenth and one-eighth of an inch thick and about one-half of an inch in width. The lips 82 may be secured by adhesive to the open ends of the shell wall panels 24 and 28. Alternatively they can be constructed to snap together into the channels 86 defined in the inner surfaces 30 of the side walls 24 and 28 of the shell 14 at the open end 34 thereof. The lips 82 differ from the lips 80 in that they have raised, outwardly directed ribs 84 that reside in the corresponding vertical channels 86 defined in the structures of the shell walls 24 and 28, proximate the open ends thereof. The channels 86 can extend throughout the height of the wall panels 24 and 28, parallel to the closed end panel 38. Alternatively, they may extend only a short distance, or even be constructed as detent depressions. The lips 82, like the lips 270 and 80, also form abutment ledges 78 that engage the corresponding outwardly facing edges 61 and 63 of the retainer display panel 60 and the retainer return panel 56.

Figure 9:
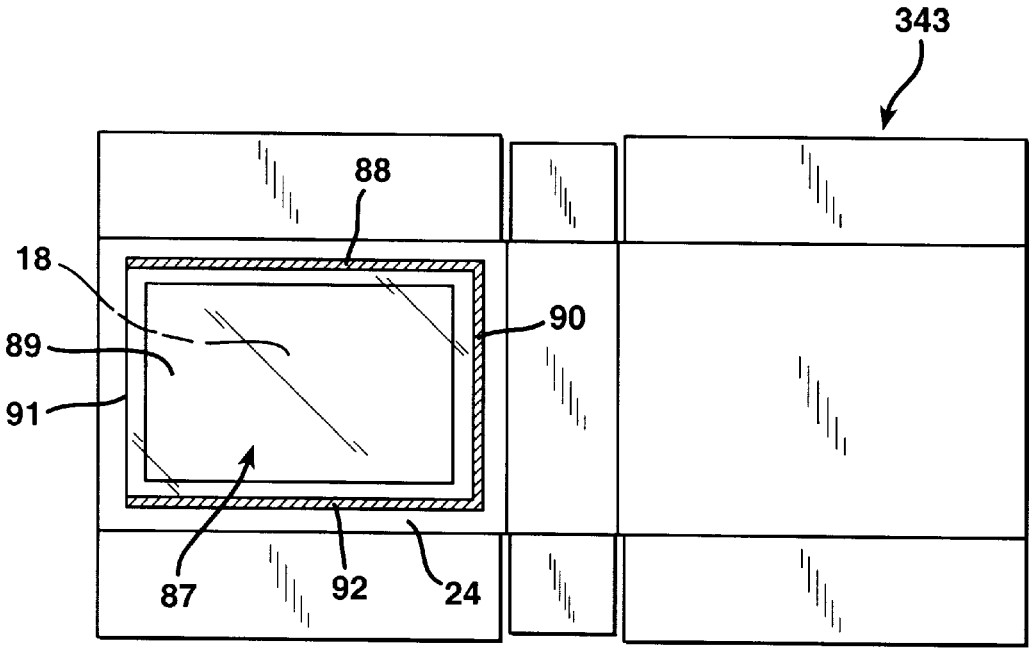
FIG. 9 is a plan view that illustrates another embodiment of a storage container shell of the invention shown in a flattened condition prior to folding and assembly.

FIG. 9 illustrates an alternative arrangement for constructing an album case shell according to the invention that employs a pocket. The flat sheet of stiff stock 343 depicted in FIG. 9 is the same as the sheet 43 shown in FIG. 1A and which is used in the construction of the shell 14, except that it lacks the catch tabs 70. However, instead of employing a retainer 16 that is inserted separately into the shell 14, a display sheet mounting pocket 87 is provided that is sealed to the inner surface 30 of the transparent display wall 24. The pocket 87 is formed of a single stiff layer of transparent material 89 which serves as a retainer and which is thermally sealed or sealed by adhesive along three of its four edges as indicated by the sealing lines 88, 90, and 92 in FIG. 9. The sheet 89 of transparent material is left unsealed at its open end 91 so as to allow insertion and removal of the display sheet 18 between the two plies of material forming the pocket 87 with the photograph 66 on the display sheet 18 thereon facing outwardly through the transparent display wall 24. The outer ply of the pocket 87 is formed by the transparent display wall 24, which thereby serves as a transparent, protective shield for the visual display sheet 18. The inner ply of the pocket 87 is formed by the sheet 89.

Figure 10:
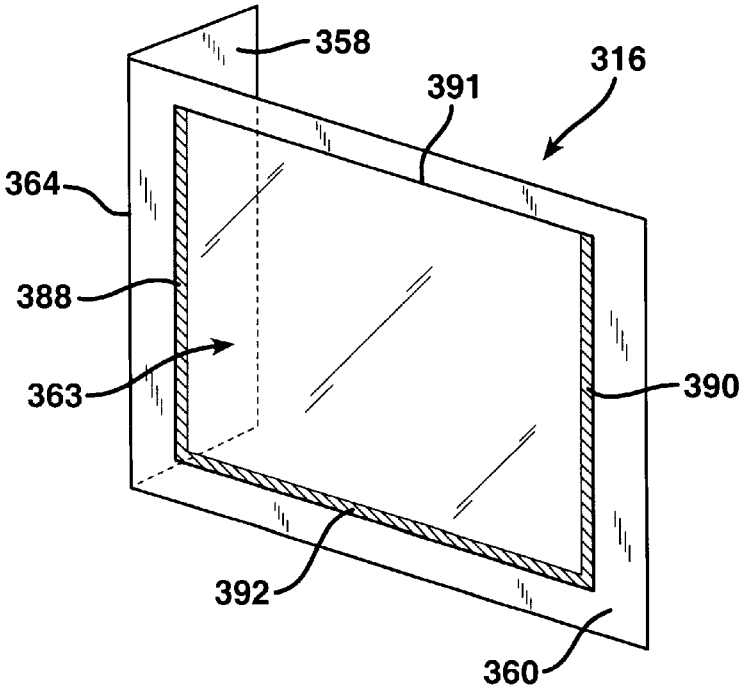
FIG. 10 is a perspective view that illustrates another embodiment of a display retainer of the storage container of the invention.

FIG. 10 illustrates an alternative embodiment of a retainer 316 that can be utilized with the album slip case shells 14, 114, or 214 shown in FIGS. 1, 2, 3, and 5. The retainer 316 is formed with a pair of articulated panels 360 and 358 which are joined together along a fold line 364. The card stock or plastic stock forming the panels 360 and 358 of the retainer 316 is resilient enough to bias the panels 360 and 358 apart from each other, as illustrated in FIG. 10.

The display retainer support panel 360 includes a pocket formed as a transparent sheet 363 which is secured to the front side of the display mounting retainer panel 360 by double sided adhesive tape, glue, or heat sealing along three of its four margins, indicated at 388, 390, and 392. The top edge 391 of the transparent, rectangular pocket sheet 363 is left unsealed.

The retainer 316 is utilized by inserting a visual display sheet 18 bearing the photograph 66, into the top of the pocket between the unsealed, upper edge 391 of the transparent sheet 363 and the outwardly facing surface of the stiff display mounting panel 360. The retainer 316 is then inserted into any one of the album shells 14, 114, or 214, and held within those shells by one or more of the fastening tabs 70, or other catch mechanisms of the types previously described. The springiness of the material forming the panels 360 and 358 is sufficient to hold the outwardly facing surface of the display mounting panel 360 in contact with the transparent display walls 24, 124, or 224 and to hold the web support panel 358 in contact with the closed end 38, 138, or 238 of the album shell 14, 114, or 214 into which the retainer 316 is inserted. The pocket formed between the transparent sheet 363 and the display mounting panel 360 serves as a device for centering the photograph 66 relative to the transparent display wall 24, 124, or 224 of the shell 14, 114, or 214 into which the album 12 is to be inserted.

Figure 5:
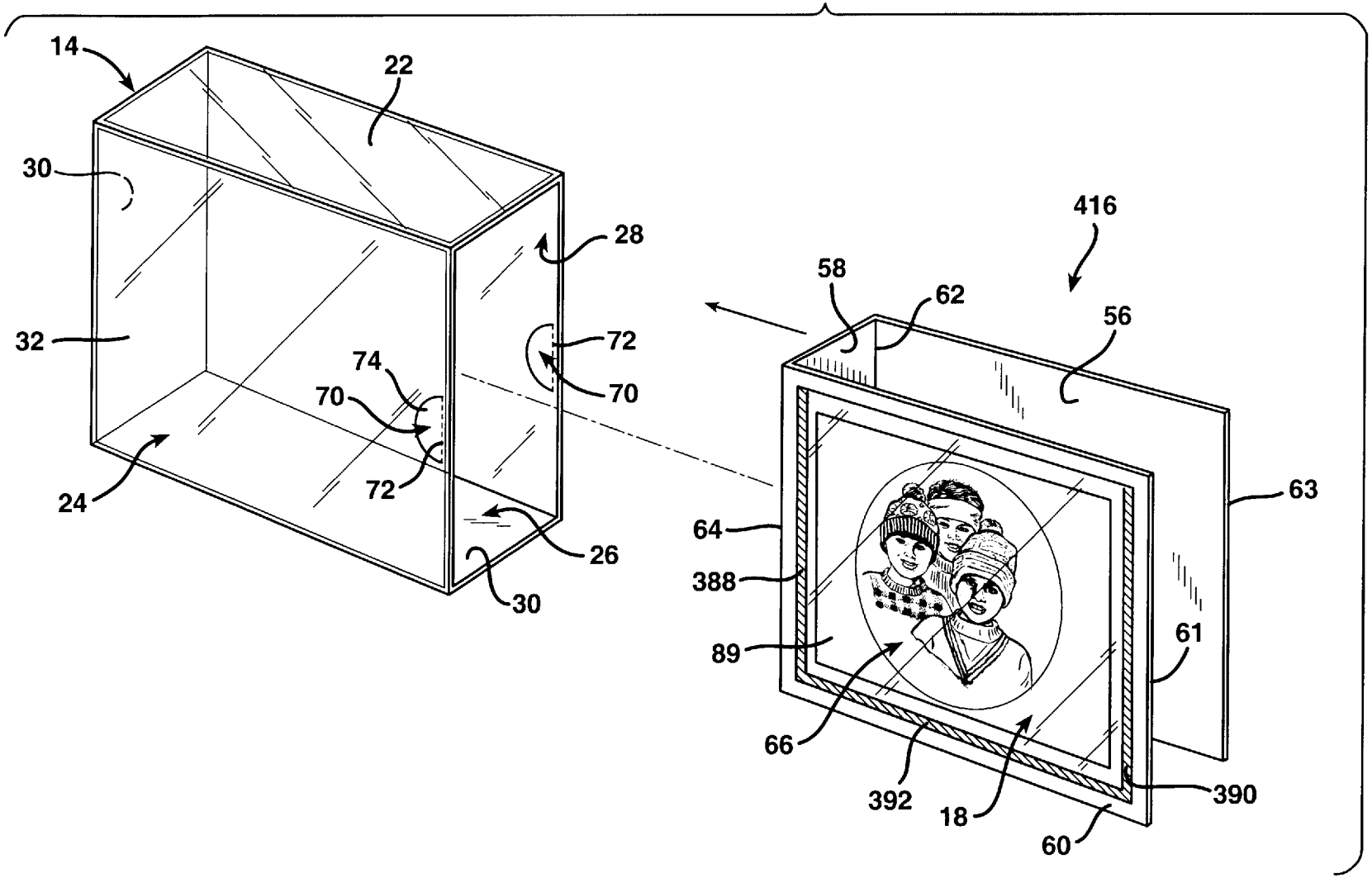
FIG. 5 is an exploded perspective view illustrating another preferred embodiment of a storage container constructed according to the invention.

FIG. 5 illustrates still another embodiment of the invention which incorporates certain features of the retainer 16 and the retainer 316. The retainer 416 also includes the web support panel 58 and a return panel 56. The retainer 416 has essentially the same U-shaped configuration as the retainer 16 and may be held in the album shell 14 by means of both the resilient bias of the stock forming the panels 56, 58, and 60 of the retainer 416, and also by the retaining tabs 70 of the shell 14 in the manner previously described. The retainer 416 illustrated in FIG. 5 employs the same transparent, outwardly facing pocket sheet 89 employed in the embodiment of FIG. 10 secured to the display mounting panel 60. The single ply of transparent material 89 is secured to the outwardly facing surface of the display retaining panel 60 by adhesive, thermal sealing, or otherwise. A transparent pocket is thereby formed on the outwardly facing surface of the display retaining panel 60 of the retainer 16. The display sheet 18 is inserted into the pocket formed between the sheet of transparent material 89 secured to the outwardly facing surface of the display retaining panel 60, and the structure of the display retaining panel 60 itself. In such an arrangement the display sheet 18 is held in essentially the same position on the display retaining panel 60 as in the embodiment of FIGS. 2, 9, and 10.

Figure 11:
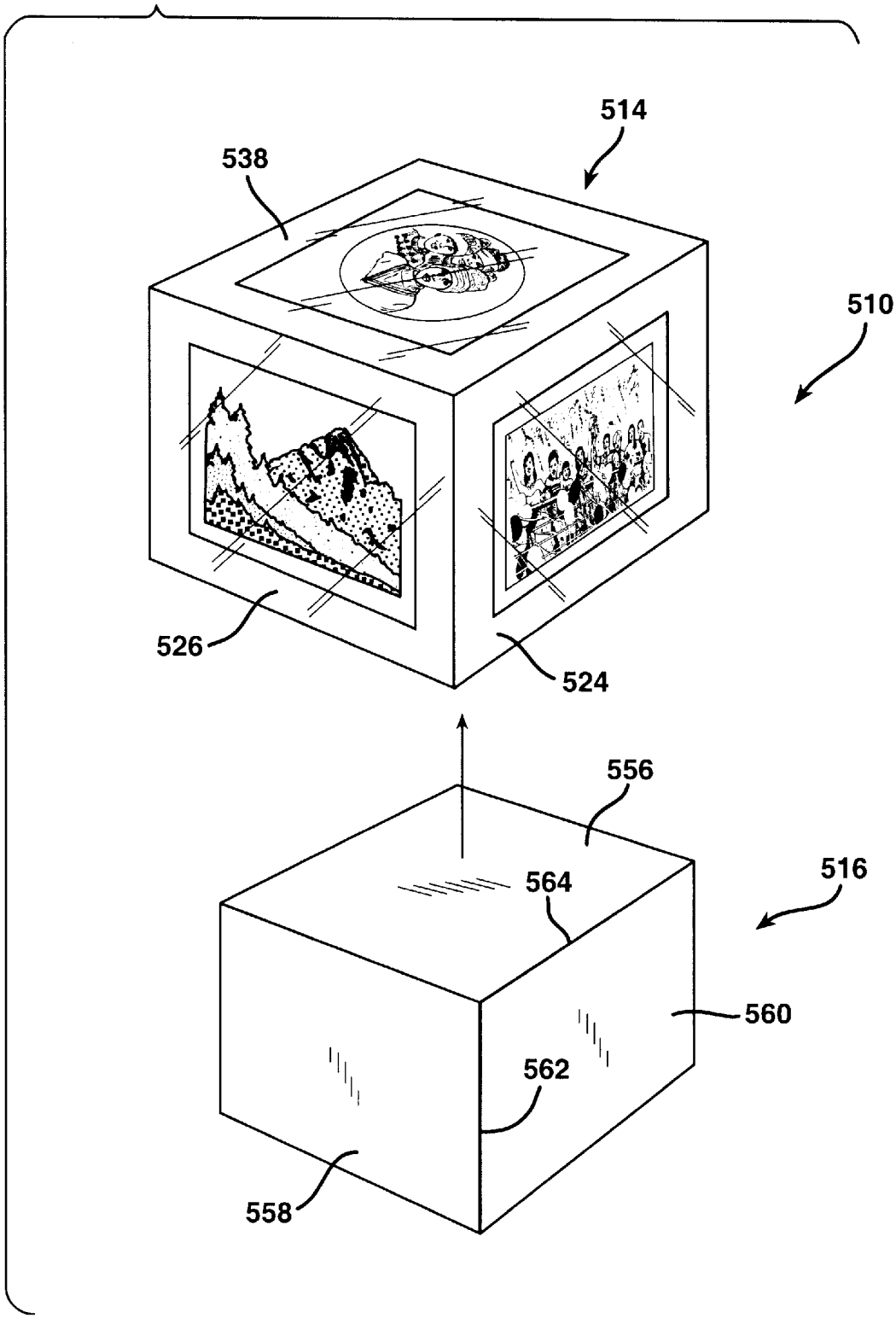
FIG. 11 is a perspective view that illustrates another embodiment of the invention having at least three transparent display walls.

The album case of the invention is not limited to embodiments which include only a single display wall in the shell 14. The album case 210, shown in FIG. 6 and previously described, is one embodiment of the invention employing a pair of transparent display wall panels 224 and 228. FIG. 11 illustrates another alternative embodiment of a storage container 510 according to the invention in which the shell 514 includes three display walls 524, 526, and 538. The display wall 538 is the transverse end wall of the shell 514, which is located opposite the open end (not visible) of the album case 510. The retainer 516 that is employed in the album case 510 does not have a U-shape like the retainer 16, but rather is formed of at least three panels that conform to the shape of and press outwardly against the shell walls 524, 526, and 538.

As is evident, the end wall panel 538 of the shell 514 is considerably vider than the end wall structure 38 of the shell 14. As a consequence, the album case 510 may accommodate three or more photo albums 12 of the type depicted in FIG. 2. The separate flat retainer display panels of the retainer 516 employed in the album case 510 are delineated by folds 562 and 564 in the retainer 516, as depicted in FIG. 11. Each of the distinct, flat retainer display panels 556, 558, and 560 respectively conforms to the shape of and covers the inner surface of a single one of the display walls 538, 526, and 524. Specifically, the retainer wall 556 conforms to the shape of and covers the inner surface of the display wall 538 of the shell 514, while the retainer display panel 558 conforms to and covers the inner surface of the wall 526. The retainer display panel 560 conforms to the shape of and covers the inner surface of the display wall 524.

Figure 13:
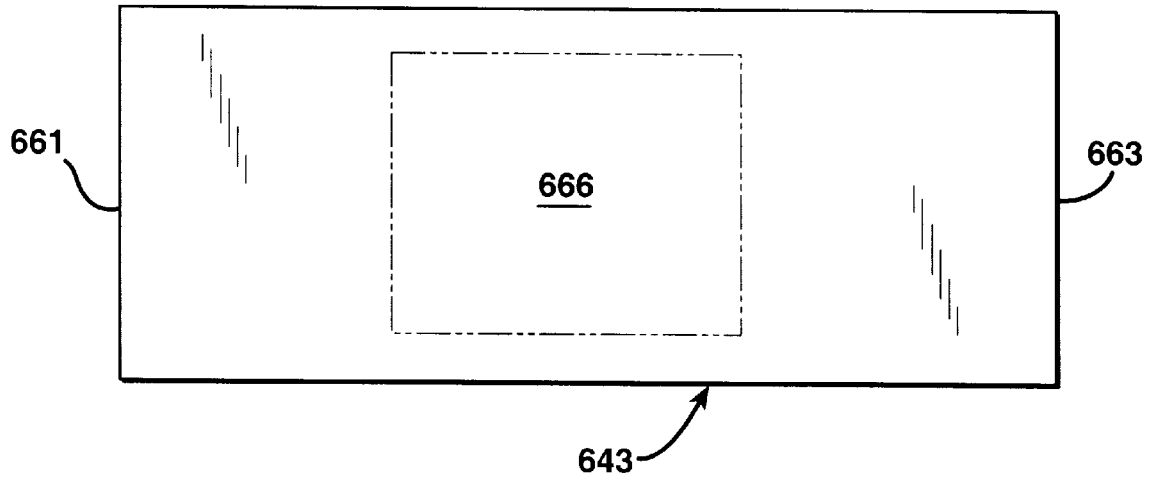
FIG. 13 is a plan view showing the retainer employed in the embodiment of FIG. 12 in a flattened condition prior to insertion into the shell.
Figure 12:
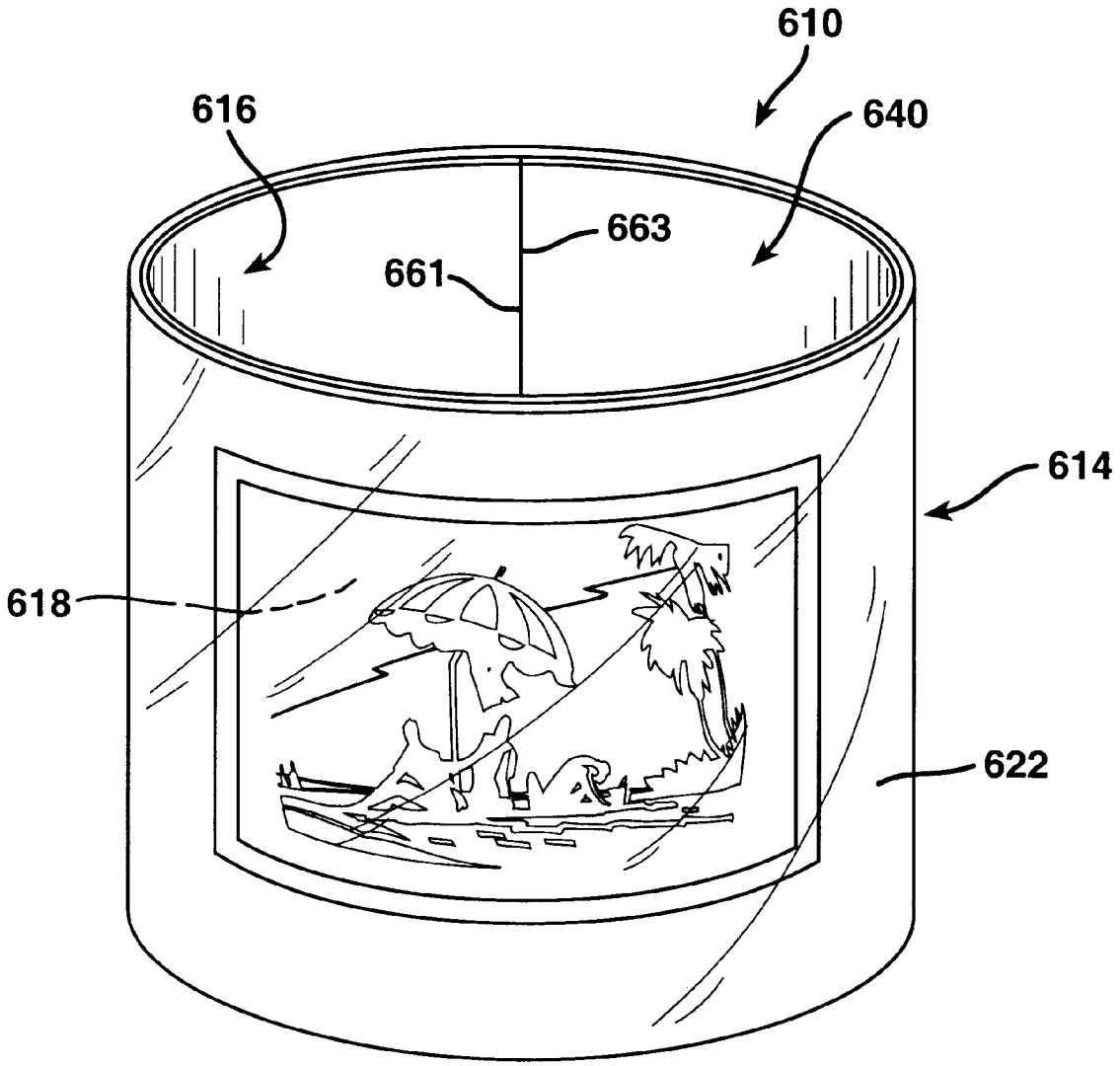
FIG. 12 illustrates an embodiment of a storage container according to the invention formed in a cylindrical shape.

The storage container of the invention may assume shapes other than rectilinear shapes. For example, FIG. 12 illustrates a storage container 610 wherein the enclosing walls 622 of the shell 614 form a cylindrical structure. The storage cavity 640 has a cylindrical shape. The display retainer 616 is shown in its flattened condition in FIG. 13 before flexing and insertion into the shell 614. The location on the retainer 616 for the display sheet 618 is indicated at 666. The display sheet 618 may be attached to the retainer 616 in any of the various ways previously described.

The retainer 616 is formed of a single, resilient rectangular sheet 643 that is bent into the shape of a cylinder and is positioned in the storage cavity 640 so that a pair of opposing edges 661 and 663 of the resilient rectangular sheet 643 forming the retainer 616 meet in longitudinal, linear abutment with each other. Alternatively, a longitudinal rib could be formed on the inner surface of the enclosing walls 622. The opposing edges 661 and 663 could then bear in abutment against this rib. In either case, the resilient rectangular sheet forming the retainer 616 exerts an outward radial force on the walls 622 of the shell 614 to press there against throughout the inner surfaces of the walls 622. The storage container 610 may, for example, be utilized to store one or more photographic slide carrousels, stacked one atop another.

Numerous other variations and modifications of the invention will become readily apparent to those familiar with article storage devices, particularly photographic album cases. For example, the open end of the shell could be provided with a closure flap. Accordingly, the scope of the invention should not be construed as limited to the specific embodiments depicted and described herein.

What is claimed is:

1. A storage container comprising:

an outer shell formed with laterally enclosing walls having inner and outer surfaces and opposing open and closed ends, and said shell includes a transverse, closed end structure having inner and outer surfaces and extending across said closed ends of said laterally enclosing walls, thereby defining a storage cavity therewithin, and said open ends of said walls form and surround an open entry to said storage enclosure, and at least one of said walls is a transparent display wall;

a stiff, inner display retainer that is resiliently deflected and fits into said storage cavity and which conforms to the shape of and covers the inner surface of said display wall; and a visual display sheet located between said display wall and said display retainer, whereby said display retainer presses against said inner surface of said transparent display wall and holds said visual display sheet pressed against said inner surface of said transparent display wall.

2. A storage container according to claim 1 wherein said retainer is formed of a sheet of stiff, resilient material that is divided into a display retaining panel and a support panel that meet at a linear articulated connection therebetween, and said retaining panel and said support panel are resiliently biased apart from each other and said display retainer extends beyond said transparent display wall whereby said support panel extends across and presses against another of said inner surfaces of said shell immediately adjacent thereto.

3. A storage container according to claim 1 wherein said storage cavity has the shape of a rectangular prism and said display retainer is formed of at least three distinct flat panels joined together, including a display retaining panel which conforms to the shape of and completely covers said inner surface of said transparent display wall, a web panel that extends beyond said transparent display wall and which covers an inner surface of said shell immediately adjacent to said transparent display wall, and a bracing panel joined to said web panel and residing in contact with a wall of said shell parallel to said transparent display wall.

4. A storage container according to claim 3 further comprising catch members formed by raised lips secured to said inner surfaces of at least some of said walls, and said display retaining panel and said bracing panel have outer edges that reside in abutment against said raised lips.

5. A storage container according to claim 1 wherein said display retainer includes a display panel facing said transparent display wall, and mounting slits are formed in said display panel and said visual display sheet has a periphery, portions of which are inserted through said mounting slits in said display panel, whereby said visual display sheet is mounted upon said retainer.

6. A storage container according to claim 1 further comprising a transparent, protective pocket sheet secured to said display retainer to form a pocket to receive said visual display sheet, so that said pocket sheet is positioned between said inner surface of said transparent display wall and said display retainer.

7. A storage container according to claim 1 wherein said shell is comprised of at least one catch member at said open end thereof that engages said display retainer and holds it against at least one of said inner surfaces of said shell.

8. A storage container according to claim 7 wherein said catch member is a restraining tab having an anchored end secured to said open end of one of said walls, and a free end directed toward said closed end structures of said shell, whereby said catch member engages and restrains said display retainer.

9. A storage container according to claim 1 wherein said shell defines a plurality of transparent display walls and said retainer includes a plurality of flat retainer display panels each of which respectively conforms to the shape of and covers the inner surface of a single one of said transparent display walls.

10. A storage container according to claim 1 wherein said retainer is formed as a single, flat panel having opposing ends, and said shell is further comprised of catch members at both said open end and said closed end of said transparent display wall, whereby said catch members engage and restrain said retainer at both of its opposing ends.

11. A storage container according to claim 1 wherein said outer shell is formed as a single sheet of stiff, transparent stock, folded to form said walls and said end structure as aforesaid.

12. A storage container according to claim 1 wherein said enclosing walls form a cylindrical structure and said display retainer is formed of a single, resilient, rectangular sheet that is bent into the shape of a cylinder, and which is positioned in said storage cavity so that it exerts an outward radial force on said walls of said shell to press there against throughout said inner surfaces of said walls.

13. A storage container according to claim 1 further comprising a display sheet mounting pocket sealed to said inner surface of said display wall for receiving said visual display sheet therewithin.

14. A storage container according to claim 1 wherein said enclosing walls of said shell include mutually opposing top and bottom walls and mutually opposing side walls, wherein said transparent display wall is one of said opposing side walls, and further comprising a foldable stand secured to said outer surface of the other of said opposing side walls, and said foldable stand is deployable to project outwardly and downwardly to a surface upon which said shell rests to support said shell so that said opposing side walls are oriented in an upright disposition.

15. An album case comprising:

a shell having a closed end structure with inner and outer surfaces, an opposite open end, and a plurality of wall panels having inner and outer surfaces and extending between said closed end structure and said open end of the shell, wherein at least one of said panels is a transparent display panel;

a stiff display retainer having at least one flat retainer panel which is resiliently deflected to conform to the shape of and press against said inner surface of said transparent display panel; and a display sheet interposed between said inner surface of said transparent display panel and said retainer panel, whereby the resilient deflection of said display retainer holds said display sheet pressed against said inner surface of said display panel.

16. An album case according to claim 15 wherein said retainer includes at least three flat retainer panels formed from a single sheet of stiff stock delineated from each other by articulated joints therebetween, and further comprising at least one catch member on said shell at said open end thereof, and said catch member engages said retainer to hold it within said shell.

17. An album case comprising:

a shell formed with four wall panels having inner and outer surfaces, each wall panel having an open end and a closed end, and a closed end structure having inner and outer surfaces secured to all of said closed ends of said wall panels to extend transversely thereacross, whereby said shell defines a hollow album enclosure, and wherein at least one of said wall panels is a transparent display wall panel;

a sheet of stiff material forming a display retaining panel that is resiliently deflected and disposed to face said inner surface of said display wall panel and to conform to and press outwardly against said display wall panel; and a display sheet interposed between said display retaining panel and said inner surface of said transparent display wall panel, and said display retaining panel holds said display sheet pressed against said inner surface of said display wall panel.

18. An album case according to claim 17 wherein said display retaining panel extends between said open and closed ends of said transparent display wall panel and said support panel is coextensive in area with the aforesaid inner surface of said shell immediately adjacent said display wall panel.

19. An album case according to claim 17 wherein said shell is provided with catch members at said open end of said transparent display wall panel and at said open end of at least one other of said wall panels and said catch members engage said retainer and hold it within said shell.

* * * * *